US010765914B1

(12) United States Patent
Trexler

(10) Patent No.: US 10,765,914 B1
(45) Date of Patent: Sep. 8, 2020

(54) REAL TIME ISOKINETIC TORQUE EXERCISE DATA MONITORING

(71) Applicant: Michael Linn Trexler, Lowell, AR (US)

(72) Inventor: Michael Linn Trexler, Lowell, AR (US)

( * ) Notice: Subject to any disclaimer, the term of this patent is extended or adjusted under 35 U.S.C. 154(b) by 0 days.

(21) Appl. No.: 16/200,135

(22) Filed: Nov. 26, 2018

Related U.S. Application Data

(63) Continuation-in-part of application No. 15/603,886, filed on May 24, 2017, now abandoned.

(60) Provisional application No. 62/340,748, filed on May 24, 2016.

(51) Int. Cl.

| | |
|---|---|
| ***A63B 24/00*** | (2006.01) |
| ***A63B 21/00*** | (2006.01) |
| ***A63B 21/04*** | (2006.01) |
| ***A63B 71/06*** | (2006.01) |

(52) U.S. Cl.

CPC .... *A63B 24/0062* (2013.01); *A63B 21/00069* (2013.01); *A63B 21/0442* (2013.01); *A63B 21/153* (2013.01); *A63B 21/4035* (2015.10); *A63B 71/0622* (2013.01); *A63B 2220/20* (2013.01); *A63B 2220/58* (2013.01); *A63B 2220/62* (2013.01)

(58) Field of Classification Search

CPC combination set(s) only.
See application file for complete search history.

(56) References Cited

U.S. PATENT DOCUMENTS

| | | | | |
|---|---|---|---|---|
| 4,041,760 | A * | 8/1977 | Henson | A61B 5/224 73/379.06 |
| 5,133,545 | A * | 7/1992 | Moschetti | A63B 21/015 482/110 |
| 6,280,361 | B1 | 8/2001 | Harvey et al. | 482/8 |
| 8,964,298 | B2 | 2/2015 | Haddick et al. | 3/13 |
| 9,409,053 | B1 | 8/2016 | Todd | 24/62 |
| 9,539,467 | B2 | 1/2017 | Hashish | 24/87 |
| 2004/0250618 | A1* | 12/2004 | Keiser | A61B 5/224 73/379.09 |
| 2010/0216600 | A1* | 8/2010 | Noffsinger | A63B 23/12 482/5 |

* cited by examiner

*Primary Examiner* — Garrett K Atkinson
(74) *Attorney, Agent, or Firm* — Keisling & Pieper PLC; David B. Pieper

(57) ABSTRACT

An individual isokinetic pull force time performance exercise training system for monitoring power on each repetition in a workout on a piece of exercise equipment with a load cell and rotary encoder integrated into the equipment with wireless data transfer and signal processing for a display to provide relevant exercise measurements viewable to a trainer or trainee in a graphical format.

1 Claim, 9 Drawing Sheets

AMAZON NOSQL DATABASE powerup-mobilehub-1050846049- Reps

Overview | Items | Metrics | Alarms | Capacity | Indexes | Triggers | Access control | Tags Create item | Actions Scan: (Table) powerup-mobilehub-1050846049-Reps: user...

| Userid | Reps_id | Distance (20) | Force (10) | Time (30) | Workout_id |
|---|---|---|---|---|---|
| us-east-1:2512e351 | 1 | ({"N" : "0.18"... | ({"N" : "1.94... | 1.1375 | 1 |
| us-east-1:2512e351 | 2 | ({"N" : "0.18"... | ({"N" : "2.36... | 10.175 | 1 |
| us-east-1:2512e351 | 3 | ({"N" : "0.18"... | ({"N" : "0.69... | 10.925 | 1 |
| us-east-1:2512e351 | 4 | ({"N" : "0.18"... | ({"N" : "0.69... | 12.2 | 1 |

GRAPHICAL RESULTS

REAL TIME ISOKINETIC TORQUE EXERCISE DATA MONITORING

CROSS-REFERENCE TO RELATED APPLICATIONS

This application claims priority to and is a continuation-in-part of U.S. application Ser. No. 15/603,886, filed on May 24, 2017 by Michael Linn Trexler entitled Real Time Isokinetic Torque Exercise Data Monitoring., which is a continuation in part of U.S. Provisional Application Ser. No. 62/340,748, filed on May 24, 2016 by Michael Linn Trexler entitled Real Time Isokinetic Torque Exercise Data Monitoring. These prior applications are incorporated by reference in their entirety.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

The present invention relates to improvements in exercise equipment. More particularly, the invention relates to improvements particularly suited for isokinetic power monitoring of individual repetitions of an exercise program.

2. Description of the Known Art

As will be appreciated by those skilled in the art, exercise machines are known in various forms. Patents disclosing information relevant to exercise include: U.S. Pat. No. 9,539,467, issued to Hashish on Jan. 10, 2017 entitled Exercise system for shifting an optimum length of peak muscle tension; U.S. Pat. No. 9,409,053, issued to Todd on Aug. 9, 2016 entitled Exercise data collection system; U.S. Pat. No. 8,964,298, issued to Haddick, et al. on Feb. 24, 2015 entitled Video display modification based on sensor input for a see-through near-to-eye display; U.S. Pat. No. 6,280,361, issued to Harvey, et al. on Aug. 28, 2001 entitled Computerized exercise system and method; and U.S. Pat. No. 4,041,760, issued to Henson, et al. on Aug. 16, 1977 entitled Exercise apparatus. Each of these patents is hereby expressly incorporated by reference in their entirety.

U.S. Pat. No. 9,409,053, issued to Todd on Aug. 9, 2016 entitled Exercise data collection system includes an abstract that reads as follows: An exercise data collection system for use with an exercise machine, including a computerized processing unit and at least two sensors mounted on or near the exercise machine to capture data indicative of aspects of exercising performed by a user of the exercise machine. A first of the at least two sensors being of a first sensor type and a second of the at least two sensors being of a second sensor type different from the first sensor type. The sensors including circuitry associated therewith sufficient to allow the sensors to wirelessly communicate captured data for receipt and analysis by the processing unit, which includes programming that will cause the processing unit to analyze the received captured data in conjunction with characteristics of the user so that a representation of the exercise performed by the user can be constructed that reflects the exercising as it was performed by the user.

From these prior references, it may be seen that these prior art patents are very limited in their teaching and utilization, and an improved real time isokinetic torque exercise data monitoring is needed to overcome these limitations.

SUMMARY OF THE INVENTION

The present invention is directed to an individual isokinetic pull force time performance exercise training system using an exercise apparatus with a pull cable exercise machine and a processing and display apparatus. The present invention provides an aid to athletic trainers and trainees in viewing their exercising progress anywhere and anytime. By installing electrical sensors and equipment to store and process data and transmit that data wirelessly the device allows various users access to their exercising data and progress for feedback based on the data results.

The present invention collects raw force and distance measurement data and transmits that data wirelessly to a display where the data is further processed into isokinetic power units. The data is then stored in a database and manipulated for easy and coherent viewing by the trainee and the trainer in a user-interactive graph.

Objects of the present invention include a processing unit that collects and stores relevant workout measurements, a transmission and reception method that transmits these workout measurements wirelessly to various displays for viewing by the trainee as well as the trainer, easy to use by trainers and trainees with no technical background needed for the user, and at a low price.

In operation, a user grabs the handle which is connected to a rope wrapped around an axis that rotates as one pulls on the rope and the resistive shaft provides a constant resistance and the force applied and the rotation of the shaft are monitored over time to collect power information for a graphical display of the manner in which the work is applied.

These and other objects and advantages of the present invention, along with features of novelty appurtenant thereto, will appear or become apparent by reviewing the following detailed description of the invention.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE INVENTION

Figure 1:
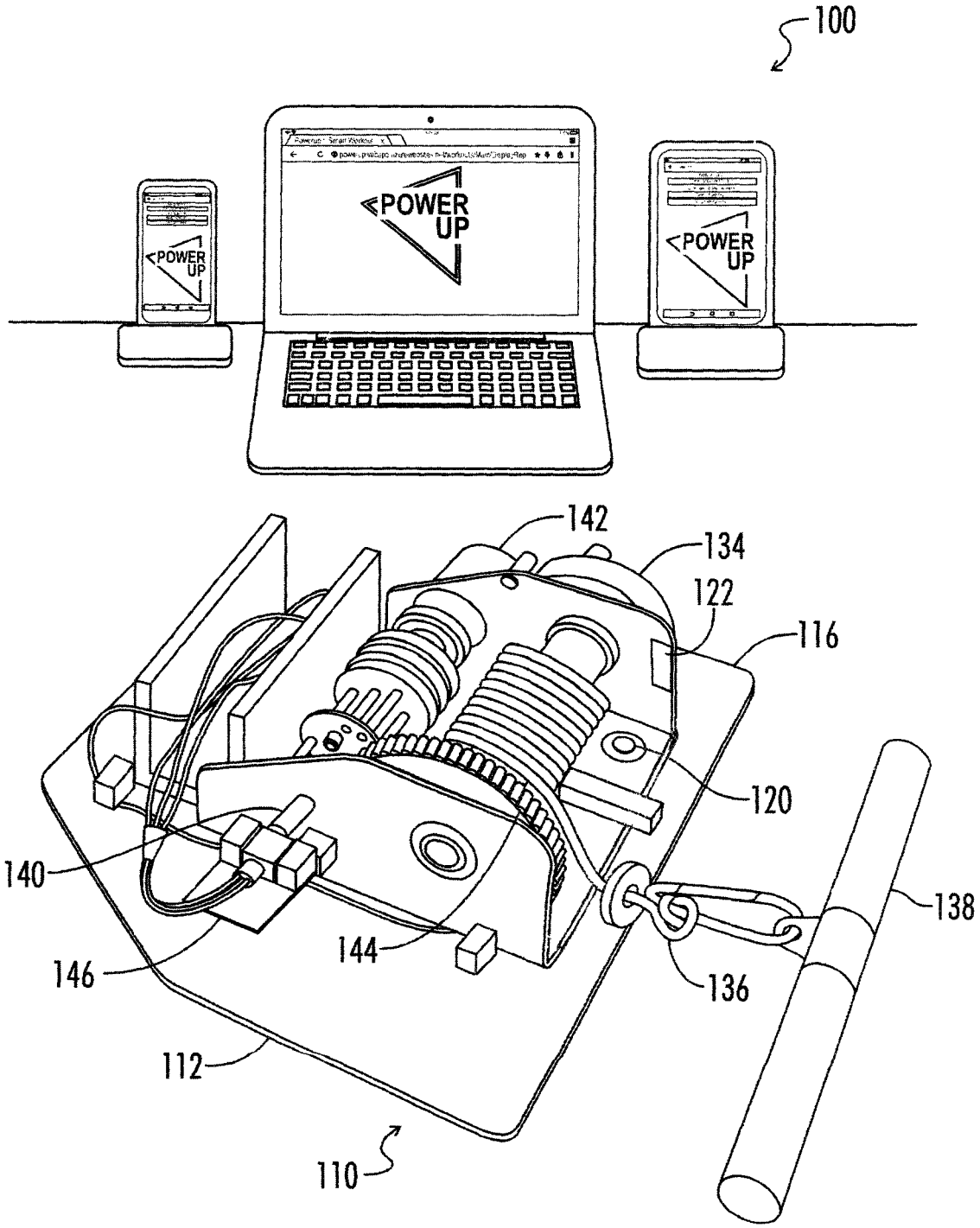
FIG. 1 is an overview of the individual pull force time performance exercise training system.
Figure 2:
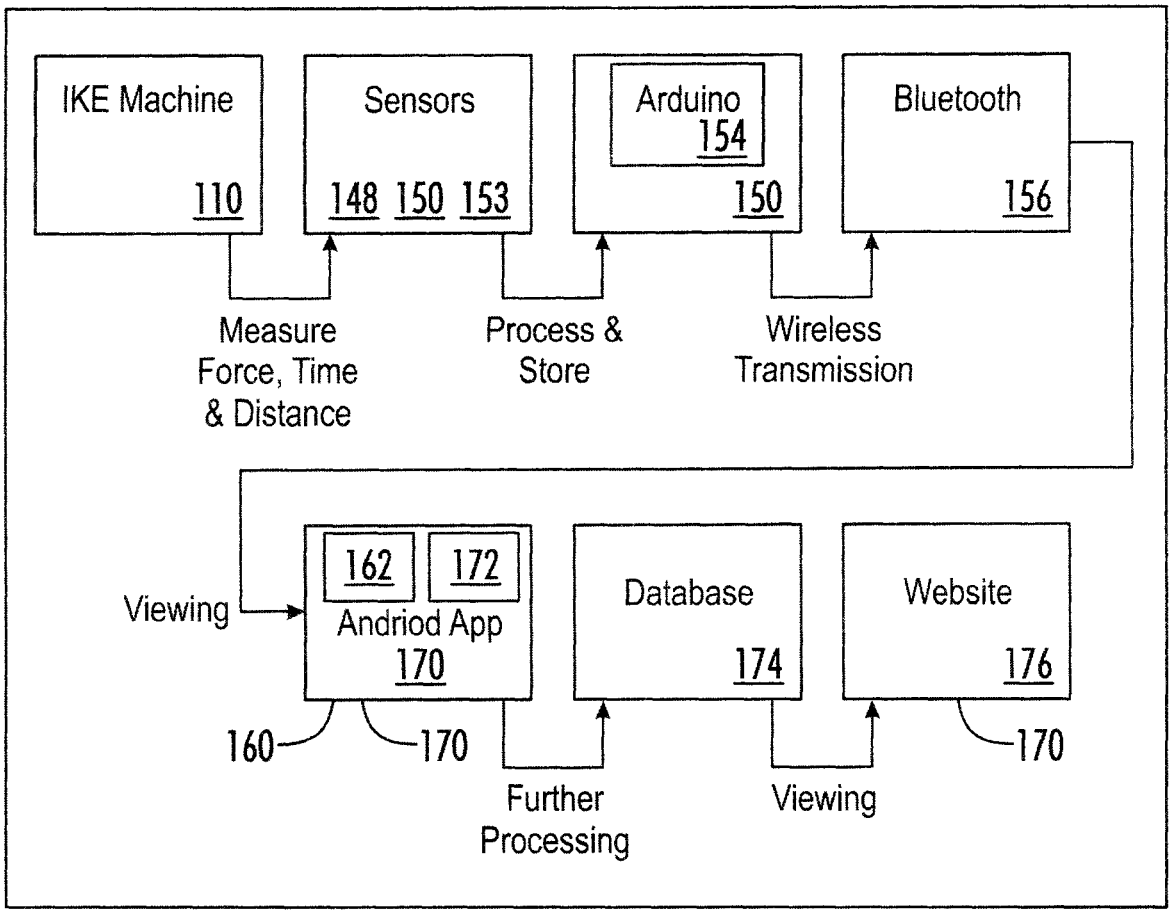
FIG. 2 is a block schematic of the system.
Figure 3:
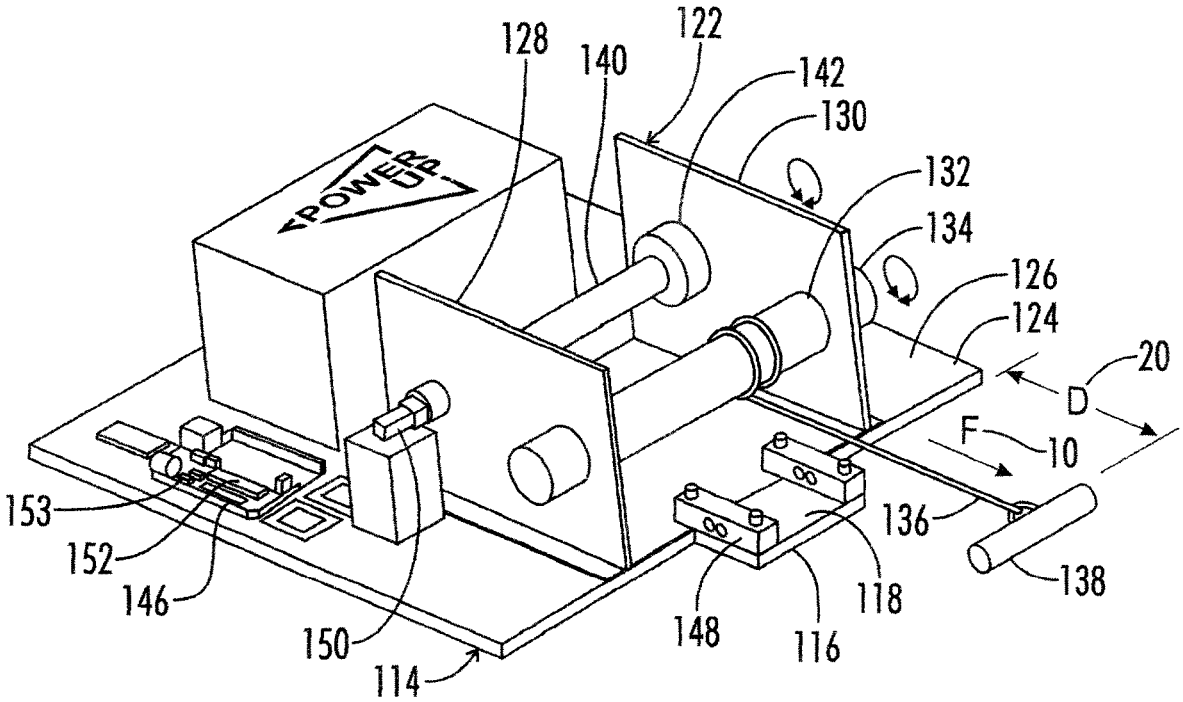
FIG. 3 is a schematic representation of the pull cable exercise machine
Figure 4:
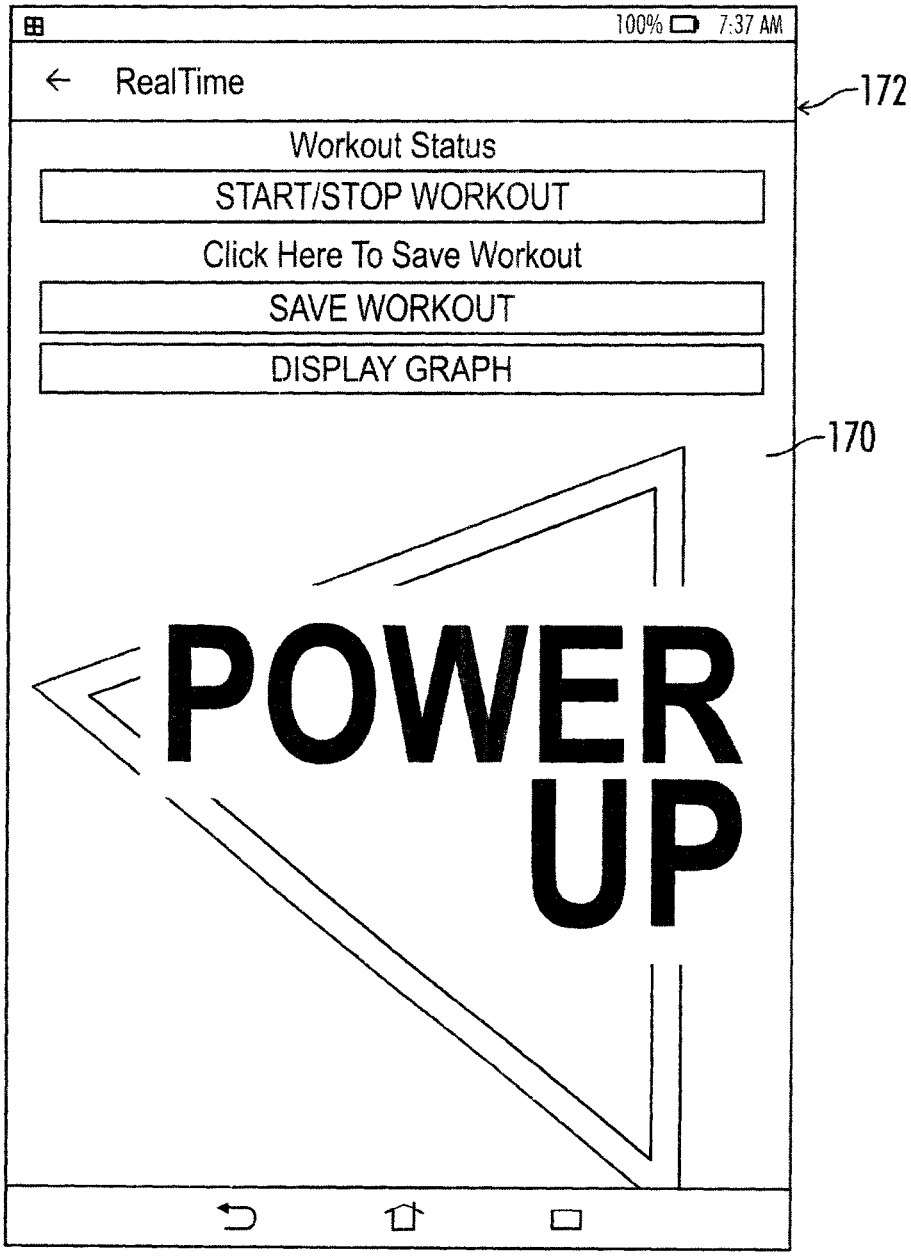
FIG. 4 shows the application main screen.
Figure 5:
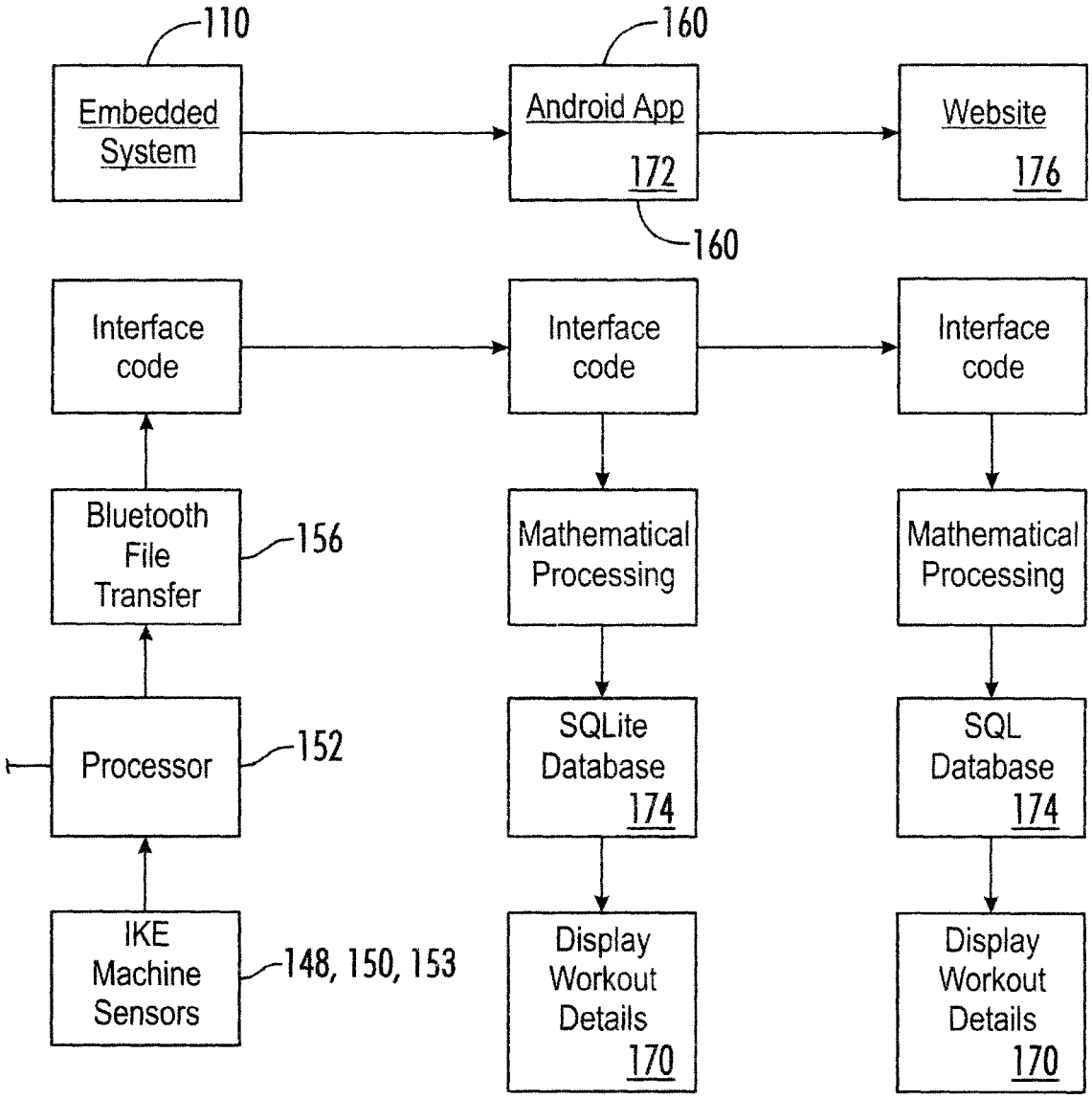
FIG. 5 is a block schematic of the information collection and processing.
Figure 6:
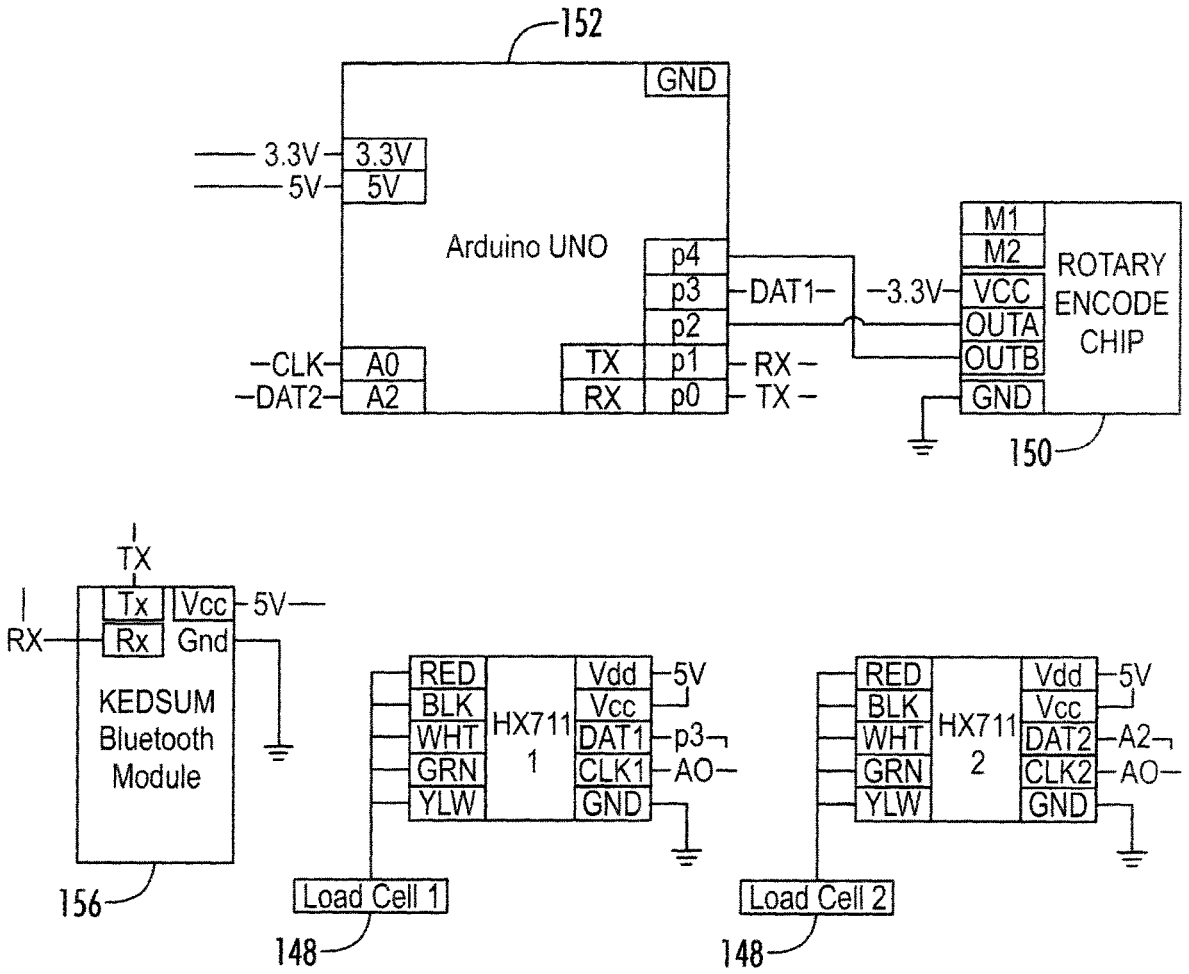
FIG. 6 is an electrical schematic of the data circuit.
Figure 7:
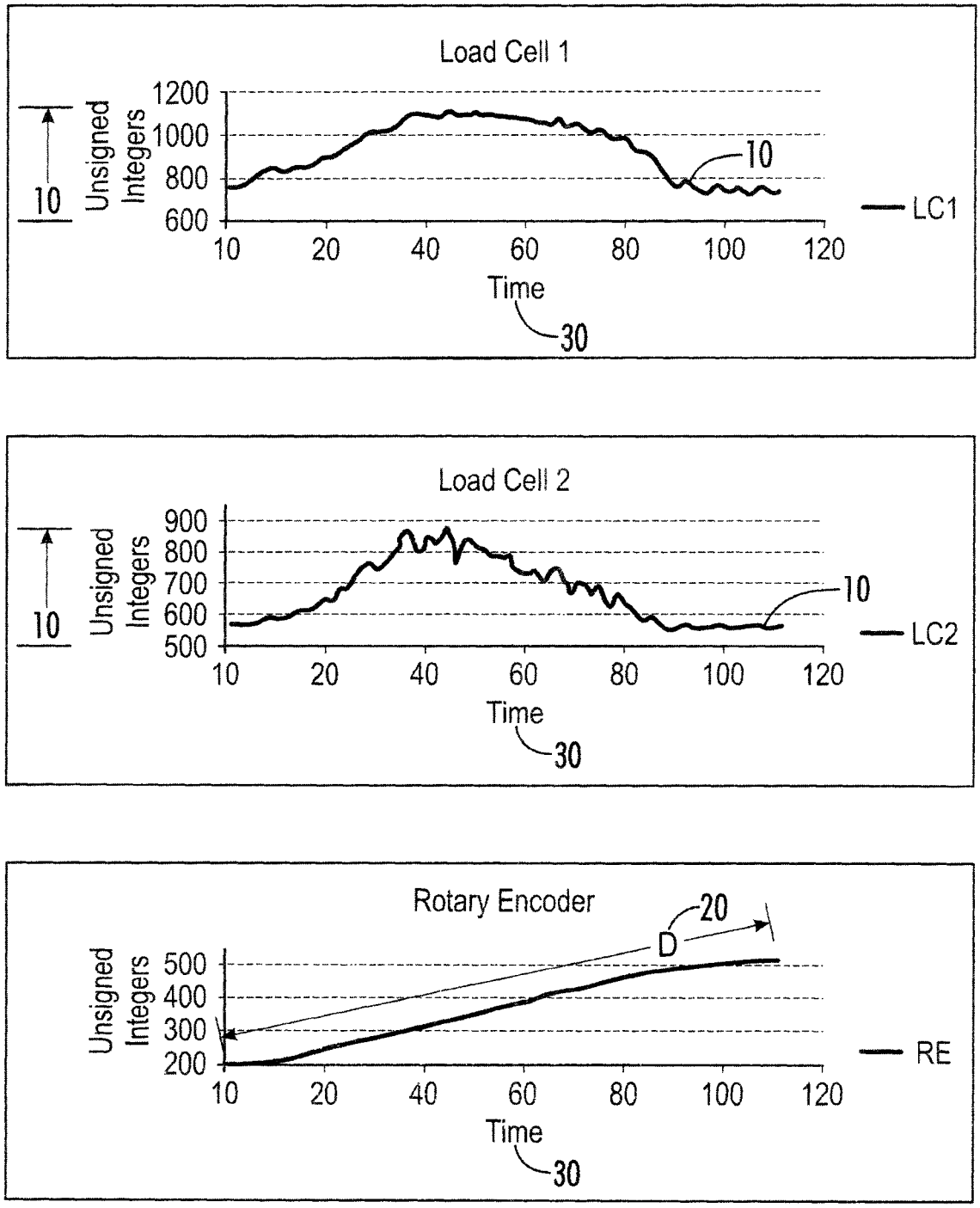
FIG. 7 are graphs of the load sensor and rotary encoder information over time.

As shown in FIGS. 1 through 8 of the drawings, one exemplary embodiment of the present invention is generally shown as an individual isokinetic pull force time performance exercise training system 100. The exercise training system 100 includes an exercise apparatus 110 with a pull cable exercise machine 112 and integrated data circuit 146 transmitting data to a processing apparatus 160 with a visual display 170 for showing an isokinetic power graph 200.

The exercise apparatus 110 includes a pull cable exercise machine 112 with an equipment base 114 having a base bottom 116 with a top base surface 118 and frame mounts 120 supporting a separate floating load frame 122 with a frame bottom 124 having a top load surface 126. In this manner, the floating load frame 122 can move in relation to the base bottom 166. A load cell 148 is connected to the floating load frame 122 and the base bottom 166 to measure the force applied by the user to the exercise apparatus 110. The user applies the force through the cable handle 138 connected to the pull cable 136 wrapped around the winding shaft 132 that is biased to rewind the cable by a spring return 134. The winding shaft 132 is rotationally supported by the left side shaft support 128 and the right side shaft support 130. Connected to the winding shaft 132 by a connecting chain 144 is a resistance shaft 140 connected to an adjustable resistance device 142 that can be of any known variety such as fluid dampening, clutch plates, etc.

The equipment data circuit 146 includes the load cells 148 and also includes rotary encoder sensors 150 as well as a Microprocessor 152 running an operating system 154 and a transmitter 156.

The load cell 148 is a 50 kg load cell attached to a load cell amplifier. Although this setup is more expensive than the other options considered, it is durable and accurate.

The rotary encoder 150 is a POLOLU rotary encoder attached to a gear motor shaft available from Pololu Corporation, 920 Pilot Rd., Las Vegas, Nev. 89119. The reason for this selection is because it is again accurate and easy to install. It also has the advantage of having the potential to recharge a battery in the future.

The microprocessor 152 is an ARDUINO UNO available from ARDUINO AG Corp. Riedstrasse 11 Cham Switzerland 6330. This microprocessor is cheap and has sufficient capability to collect the raw using a bare bones operating system 154. The operating system performs a simple loop of Read timer start time, read first load cell, read second load cell, read encoder, Read Timer end time, sending of raw data, Loop back to read timer start time. Note that because the microprocessor 152 clock 153 is significantly faster than the pull of the repetition of the user, this method provides at least 100 time period reads for any single pull of the cable 136 on the machine 112. The data collected from the load cells and rotary encoder is raw data and needs to be converted into coherent force and distance units but this will be done on the display side of the transmission. Sending of the date is done through a transmitter 156 implemented with a KEDSUM Bluetooth module available from Guangzhou HC Information Technology Co., Ltd, Room 527, No.13, Jiangong Road, Tianhe software park, Tianhe district, Guangzhou. Bluetooth transfer of data was selected as it is a reliable and relatively simple way to transfer data using a variety of methods.

Because the processor speed can be set faster than the maximum rotary encoder change, the rotary encoder signal can also be used as an alternative interrupt to read and transmit so that the unit only transmits when being used. Both the constant loop system and the interrupt style transmission system allow for rapid reading and data transmission which allows for utilization of the processing power and large memory available at the processing apparatus 160 on the receiving end of the signal.

The load cells 148 measure the force that the user exerts while pulling up on the handle 138 causing the floating load frame 122 to raise which presses against the load cells 148 causing them to deflect which, through a Wheatstone bridge, converts that deflection into an electrical signal which is read by the amplifiers that communicate with the microprocessor 152. The rotary encoder 150 is attached to the resistive shaft 140 and as one pulls up doing a rep, the shaft 140 rotates which causes the magnetic rotary encoder 150 to rotate, sending a pulse through the rotary encoder chip to the microprocessor 152. The microprocessor 152 then sends the data to the processing apparatus 160. The buffers that are collecting the sensor data are then cleared and ready for new data.

The processing apparatus 160 is a standard phone, ipad, or other computer device with the capability to receive, collect, and manipulate data and display it to a screen or print out reports. Specifically, Isokinetic Power Units and Calories can be calculated from the raw data. This creates a data collection system that reads from sensors and allows the data to be remotely viewed on a website that can be seen anywhere in the world. In the preferred embodiment, the phone's Bluetooth receiver 162 feeds the data to an ANDROID application 172 that feeds the processed information to a visual display 170. ANDROID devices are available from GOOGLE Inc., 1600 Amphitheatre Parkway, Mountain View, Calif. 94043.

The application 172 receives data via the receiver 162 and is then stored in the online database 174. Essential to the conversion process is the use of appropriate conversion factors that relate the change in force measured by the Load Cells and the distance measured by the Rotary Encoder in units that make sense to people. For the preferred embodiment, force is measured in units of Pounds Force (lbf) and Distance is measured in inches (in). The application 172 computes the various parameters that were selected including max force, max time, Calories, and Isokinetic power units.

The application 172 was chosen to be the local display, processing unit, and means to transmit processed workout data to an online database 174 and website 176. By using an application 172, purchasers of the system 100 can bring their own device. This allows one to download the latest version of the software where apps are officially obtained, and update their system on the go. For each repetition, the following parameters can be displayed or graphed: Force, Distance, Time, Calories, and Isokinetic Units.

The final design of the database 174 is housed on cloud services on the internet. The reduced design time and automatic integration are the primary reasons for choosing this as the back-end for the application.

The application 172 and website 176 can display a repetition isokinetic power graph 200 showing a power measurement 202 over a time 30. The Power measurement 202 equals force measured by the load cells 148 times change in distance recorded by the rotary encoder 150 divided by the time passage indicated by the clock. Thus, small incremental isokinetic power units are calculated using Power=Force*distance/time for each read loop of the microprocessor 172 so that at least 100 single isokinetic power data points are available for any single pull. This can be seen in the graphs of FIGS. 8 and 9 so that the isokinetic power data can then be displayed as one graph 200 to show power input over the larger time of the whole repetition so that force, distance, and time information are combined in a consistent repeatable power measurement 202 that the exercise regimen can be adjusted. The whole repetition starts when the cable is pulled and continues through the extending stroke and back through the rewind of the cable until the handle is returned to its starting position.

Because the application 172 operates on the order of about 100 times faster than the microprocessor 152 it is ideal for performing the mathematical processing as compared to the microprocessor 152

Figure 8:
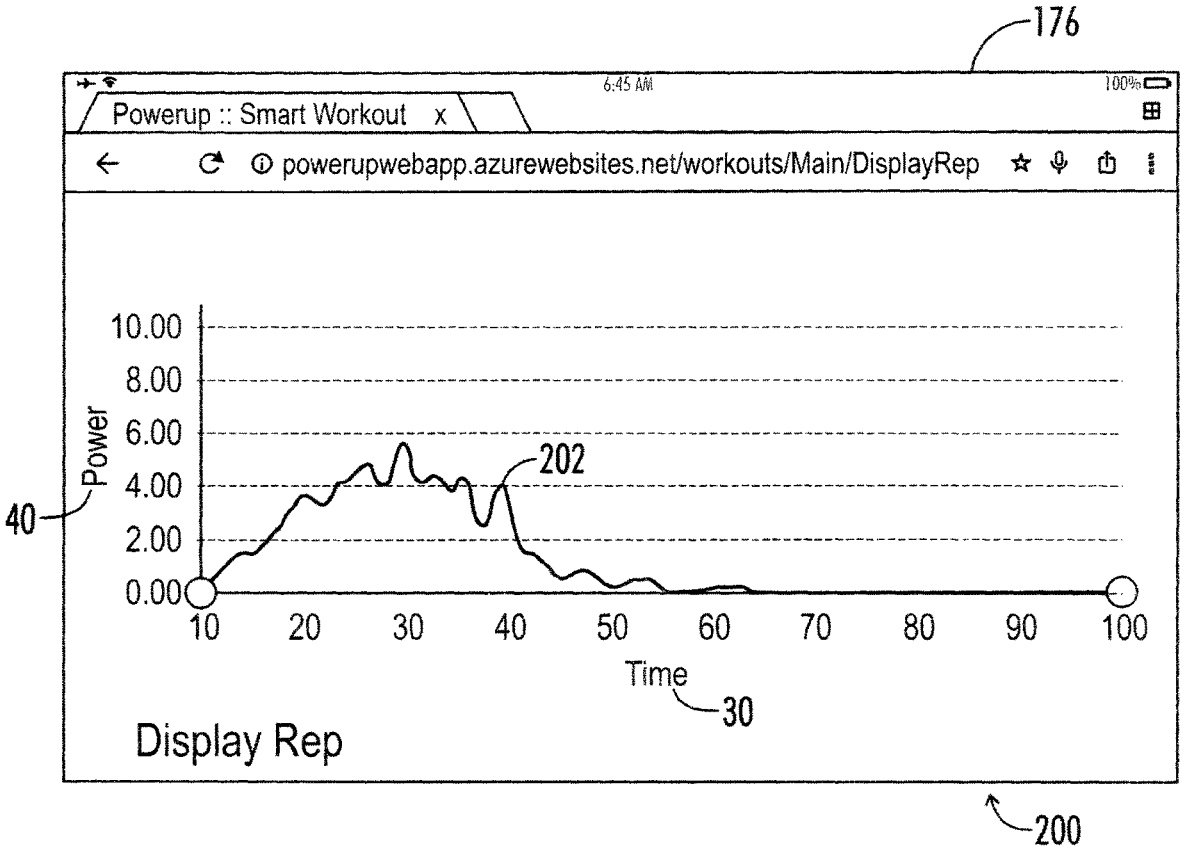
FIG. 8 shows the individual pull force time performance graph displayed on a website.
Figure 9:
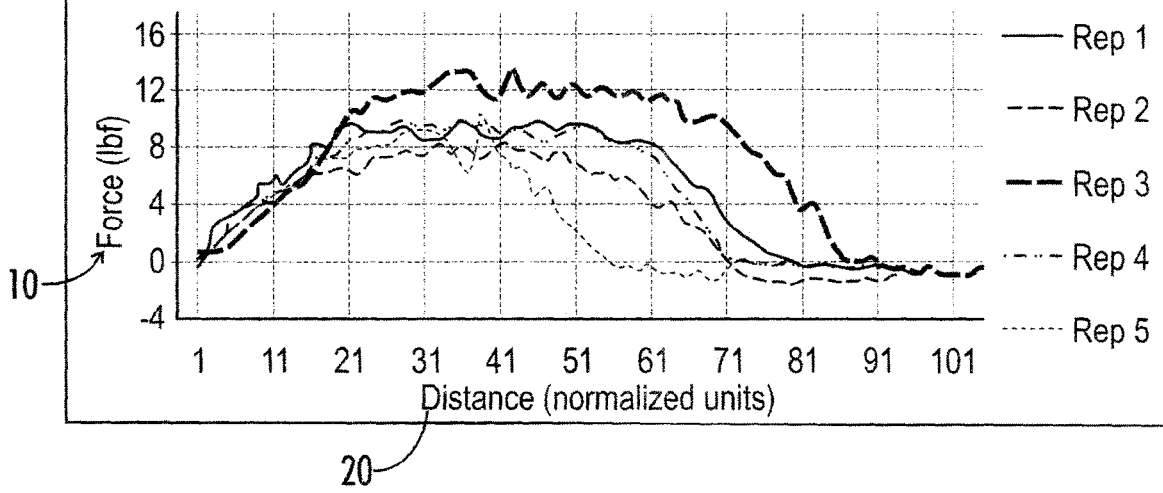
FIG. 9 shows the database layout and the force to distance graphing of multiple repetitions for cross comparison.

FIG. 8 shows the individual isokinetic power graphing performance graph displayed on a website and FIG. 9 shows the database layout and the force to distance graphing of multiple repetitions for cross comparison between exercise repetitions.

Reference numerals used throughout the detailed description and the drawings correspond to the following elements:

| | |
|---|---|
| Force | 10 |
| Distance | 20 |
| Time | 30 |
| Power | 40 |
| Individual isokinetic pull force time performance exercise training system | 100 |
| Exercise apparatus | 110 |
| Pull cable exercise machine | 112 |
| Equipment base | 114 |
| Base bottom | 116 |
| Top base surface | 118 |
| Frame mounts | 120 |
| Floating load frame | 122 |
| Frame bottom | 124 |
| Top load surface | 126 |
| Left side shaft support | 128 |
| Right side shaft support | 130 |
| Winding shaft | 132 |
| Spring return | 134 |
| Pull cable | 136 |
| Cable handle | 138 |
| Resistance shaft | 140 |
| Adjustable resistance device | 142 |
| Connecting chain | 144 |
| Data Circuit | 146 |
| Load cell | 148 |
| Rotary encoder | 150 |
| Microprocessor | 152 |
| Clock | 153 |
| operating system | 154 |
| transmitter | 156 |
| processing apparatus | 160 |
| receiver | 162 |
| Visual display | 170 |
| application | 172 |
| database | 174 |
| website | 176 |

-continued

| | |
|---|---|
| single repetition isokinetic power graph | 200 |
| power measurement | 202 |

From the foregoing, it will be seen that this invention well adapted to obtain all the ends and objects herein set forth, together with other advantages which are inherent to the structure. It will also be understood that certain features and subcombinations are of utility and may be employed without reference to other features and subcombinations. This is contemplated by and is within the scope of the claims. Many possible embodiments may be made of the invention without departing from the scope thereof. Therefore, it is to be understood that all matter herein set forth or shown in the accompanying drawings is to be interpreted as illustrative and not in a limiting sense.

When interpreting the claims of this application, method claims may be recognized by the explicit use of the word 'method' in the preamble of the claims and the use of the 'ing' tense of the active word. Method claims should not be interpreted to have particular steps in a particular order unless the claim element specifically refers to a previous element, a previous action, or the result of a previous action. Apparatus claims may be recognized by the use of the word 'apparatus' in the preamble of the claim and should not be interpreted to have 'means plus function language' unless the word 'means' is specifically used in the claim element. The words 'defining,' having,' or 'including' should be interpreted as open ended claim language that allows additional elements or structures. Finally, where the claims recite "a" or "a first" element of the equivalent thereof, such claims should be understood to include incorporation of one or more such elements, neither requiring nor excluding two or more such elements.

What is claimed is:

1. An exercise training system apparatus for a user doing a whole repetition, the apparatus comprising:

a pull cable exercise machine with an equipment base including frame mounts to moveably support a floating load frame;

the floating load frame including a first side shaft support and a second side shaft support;

a rotatable winding shaft rotatably supported by the first side shaft support and the second side shaft support;

a spring return connected to the rotatable winding shaft;

a pull cable wound on the rotatable winding shaft;

a cable handle connected to the pull cable;

a resistance shaft rotatably supported by the first side shaft support and the second side shaft support and coupled to the rotatable winding shaft by a connecting chain;

an adjustable resistance device connected to the resistance shaft;

a data circuit including a microprocessor monitoring a load cell measuring force, a rotary encoder measuring distance, and a clock measuring time and transmitting the force, distance and time; and a processing apparatus receiving the force, distance and time and generating a visual display graph showing power at multiple points over the time of the whole repetition and a force to distance graph over the length of the whole repetition, the whole repetition starting when the cable is pulled and including both an outward pull and inward rewind of the cable.

* * * * *